US011260615B2

(12) United States Patent
Cheich et al.

(10) Patent No.: US 11,260,615 B2
(45) Date of Patent: Mar. 1, 2022

(54) DUNNAGE CONVERSION MACHINE HAVING A VARIABLE SPACING FOR EXPANDABLE SLIT-SHEET STOCK MATERIAL

(71) Applicant: Ranpak Corp., Concord Township, OH (US)

(72) Inventors: Robert C. Cheich, Independence, OH (US); Dennis J. Wagner, Painesville, OH (US)

(73) Assignee: Ranpak Corp., Concord Township, OH (US)

( * ) Notice: Subject to any disclaimer, the term of this patent is extended or adjusted under 35 U.S.C. 154(b) by 267 days.

(21) Appl. No.: 16/497,174

(22) PCT Filed: Mar. 22, 2018

(86) PCT No.: PCT/US2018/023799

§ 371 (c)(1),
(2) Date: Sep. 24, 2019

(87) PCT Pub. No.: WO2018/175742

PCT Pub. Date: Sep. 27, 2018

(65) Prior Publication Data

US 2020/0016860 A1 Jan. 16, 2020

Related U.S. Application Data

(60) Provisional application No. 62/476,488, filed on Mar. 24, 2017.

(51) Int. Cl.
*B31D 5/00* (2017.01)
*B65H 23/04* (2006.01)

(52) U.S. Cl.
CPC ..... *B31D 5/0065* (2013.01); *B65H 23/048* (2013.01); *B31D 2205/0023* (2013.01); *B31D 2205/0047* (2013.01); *B31D 2205/0082* (2013.01)

(58) Field of Classification Search
CPC ..... B65H 23/048; B31D 1/0031; B31D 2205/0017; B31D 2205/0023;
(Continued)

(56) References Cited

U.S. PATENT DOCUMENTS 5,538,778 A 7/1996 Hurwitz
5,667,871 A 9/1997 Goodrich
(Continued)

FOREIGN PATENT DOCUMENTS

DE 19911628 A1 9/2000
EP 0978372 A2 1/2007
(Continued)

OTHER PUBLICATIONS

International Search Report and Written Opinion dated Jun. 12, 2018 for PCT/US2018/023799.

*Primary Examiner* — Andrew M Tecco
*Assistant Examiner* — Nicholas E Igbokwe
(74) *Attorney, Agent, or Firm* — Renner, Otto, Boisselle & Sklar, LLP

(57) ABSTRACT

A dunnage conversion machine for converting an expandable pre-slit sheet stock material into a relatively less dense dunnage product includes an improved expansion assembly that provides means for adjusting the spacing between axes of rotation of components through which the sheet stock material is drawn. The adjustability enables pre-slit sheet stock materials of differing thicknesses and/or having differing slit patterns to be fed through the expansion assembly with no or minimal compression of an expanded dunnage product, jamming in the conversion machine, bunching, and/or tearing of the pre-slit sheet stock material or expanded dunnage product resulting from expansion of the pre-slit sheet stock material.

10 Claims, 15 Drawing Sheets

(58) Field of Classification Search
CPC .... B31D 2205/0047; B31D 2205/0076; B31D 2205/0082; B31D 5/0065
See application file for complete search history.

(56) References Cited

U.S. PATENT DOCUMENTS

| | | | | |
|---|---|---|---|---|
| 5,688,578 | A | 11/1997 | Goodrich | |
| 5,782,735 | A * | 7/1998 | Goodrich | B31D 1/0031 225/100 |
| 7,258,657 | B2 * | 8/2007 | Ratzel | B31D 5/0047 493/340 |
| 9,376,280 | B2 * | 6/2016 | Page | B65D 85/672 |
| 9,701,091 | B2 * | 7/2017 | Page | B65H 16/005 |
| 2009/0082187 | A1 * | 3/2009 | Cheich | B65D 81/03 493/350 |
| 2009/0108522 | A1 | 4/2009 | Kato | |
| 2015/0140265 | A1 | 5/2015 | Page | |
| 2016/0130104 | A1 * | 5/2016 | Page | B65H 23/08 242/594 |
| 2018/0236742 | A1 * | 8/2018 | Cheich | B31D 1/0031 |

FOREIGN PATENT DOCUMENTS

| | | | |
|---|---|---|---|
| JP | S6061434 | A | 4/1985 |
| JP | 2003011252 | A | 1/2003 |
| WO | 199507225 | A2 | 3/1995 |
| WO | 2015103251 | A1 | 7/2015 |
| WO | 2016077728 | A1 | 5/2016 |
| WO | 2016137740 | A1 | 9/2016 |
| WO | 2017039792 | A1 | 3/2017 |
| WO | 2017074535 | A1 | 5/2017 |

* cited by examiner

DUNNAGE CONVERSION MACHINE HAVING A VARIABLE SPACING FOR EXPANDABLE SLIT-SHEET STOCK MATERIAL

RELATED APPLICATIONS

This application is a national phase of International Application No. PCT/US2018/023799 filed Mar. 22, 2018, and published in the English language, and which claims priority to U.S. Application No. 62/476,488 filed Mar. 24, 2017, which are hereby incorporated herein by reference.

FIELD OF THE INVENTION

This invention relates generally to a dunnage conversion machine and method for converting a pre-slit expandable sheet stock material into a dunnage product, and more particularly to a dunnage conversion machine and method for converting varying types of expandable slit-sheet stock material into respective expanded dunnage products.

BACKGROUND

In the process of shipping one or more articles from one location to another, a packer typically places some type of dunnage material in a shipping container, such as a cardboard box, along with the article or articles to be shipped. The dunnage material typically is used to wrap the articles or to partially or completely fill the empty space or void volume around the articles in the container. By filling the void volume, the dunnage prevents or minimizes movement of the articles that might lead to damage during the shipment process. The dunnage also can perform blocking, bracing, or cushioning functions. Some commonly used dunnage materials are plastic foam peanuts, plastic bubble pack, air bags, and converted paper dunnage material.

Expanded slit-sheet dunnage products are particularly useful as a cushioning material for wrapping articles and as a void-fill material. An expandable slit-sheet stock material typically has a plurality of slits pre-formed in the sheet material. Different shapes, spacing, and sizes of slits are possible. When tension is applied across the slits, the slits will open, sheet material between the slits will rotate out of the original plane of the unexpanded sheet material, and the sheet material will expand from a substantially flat, two-dimensional sheet with minimal thickness to a relatively less dense dunnage product having increased thickness, an increased length dimension parallel to the direction of applied tension, and a decreased width dimension transverse the direction of the applied tension. The term expanding, as used herein, refers to a three-dimensional expansion, or a volume expansion, of the slit sheet stock material under tension. The material generally expands in length and thickness while decreasing in width, to yield increased volume and a comparable decrease in density. Slit-sheet dunnage material, and the manufacturing thereof, are described in U.S. Pat. Nos. 5,667,871 and 5,688,578, the disclosures of which are incorporated herein by reference in their entireties.

SUMMARY OF THE INVENTION

While many dunnage conversion machines produce an adequate dunnage product, existing dunnage conversion machines and dunnage products might not be ideal for all applications. Further, existing dunnage conversion machines may not be ideal for use with varying types of stock material, such as varying types of expandable slit-sheet stock material. The present invention provides a dunnage conversion machine for converting an expandable pre-slit sheet stock material into a relatively less dense dunnage product, and that is easy to adjust for use with varying types of the expandable pre-slit sheet stock material, which may have different shapes, lengths, orientations, or spacing between slits or rows of slits. The conversion machine provided by the present invention has an improved expansion assembly that provides means for adjusting the spacing between axes of rotation of components through which the sheet stock material is drawn. The adjustability enables pre-slit sheet stock materials of differing thicknesses and/or having differing slit patterns to be fed through the expansion assembly. The feeding takes place with no or minimal compression of an expanded dunnage product, jamming in the conversion machine, bunching, and/or tearing of the pre-slit sheet stock material or expanded dunnage product resulting from expansion of the pre-slit sheet stock material.

The expandable slit-sheet stock material is generally a pre-slit-sheet stock material, having a plurality of transversely-extending rows of slits. The rows are longitudinally-spaced from one another. Each row includes a plurality of slits dispersed across the row. And the slits in each row typically are arranged in a staggered or offset relationship relative to the slits in adjacent rows.

A dunnage conversion system for expanding the improved slit-sheet stock material includes a dunnage conversion machine, also referred to as a converter. The dunnage conversion machine includes a frame having laterally-spaced support members and a support coupled to the frame capable of supporting a supply of sheet stock material. First and second expansion members are rotatably coupled to the frame for rotation about respective parallel first and second axes of rotation. The first and second expansion members are spaced apart to receive an expandable sheet stock material therebetween. Laterally-spaced support members are pivotably coupled to the frame to support lateral end portions of the first expansion member such that pivoting movement of the support members changes a position of the first axis of rotation of the first expansion member relative to the second axis of rotation of the second expansion member. An adjustment member is coupled to one pivoting support member of the pivoting support members. The adjustment member has a plurality of sections, with at least two of the sections having a different thickness. The adjustment member is selectively positionable in any of a plurality of positions such that the sections of differing thickness are positionable relative to the first axis of rotation to adjust the position of the one pivoting support member in any of a plurality of positions. Adjusting the position of the adjustment member changes the position of the first axis of rotation relative to the second axis of rotation.

At least a portion of the support member may be disposed between the positionable sections of differing thickness and the first axis of rotation.

The dunnage conversion machine may further include another adjustment member coupled to the other pivoting support member of the pivoting support member.

The thickness dimension of each of the sections of differing thickness may extend along a plane disposed orthogonal to the first axis of rotation.

The adjustment member may be configured such that the plurality of positions into which the adjustment member is selectively positionable are predetermined positions.

The adjustment member may be selectively positionable such that the parallel relationship between the first and second axes of rotation is maintained at each of the plurality of positions of the adjustment member.

The positionable sections of differing thickness may be interchangeably positionable into an acting position effecting movement of the position of the first axis of rotation, and one section of differing thickness at a time can occupy the acting position.

The sections of differing thickness may be circumferentially spaced apart about the adjustment member.

The adjustment member may be rotatable about an adjustment axis relative to the frame to effect pivoting of the support member.

The adjustment member may be configured such that eccentric rotation of the adjustment member effects pivoting of the support member.

The eccentric rotation of the adjustment member may be effected by an offset spacing between an axis of rotation of the adjustment member and a central axis of the adjustment member.

Adjacent sections of the plurality of sections of differing thickness may be longitudinally separated from one another along a length of the adjustment member by a respective ramp portion.

The adjustment member may be linearly translatable between the plurality of positions of the adjustment member.

The dunnage conversion machine may be in combination with a supply of expandable pre-slit stock material.

The dunnage conversion machine may further include a biasing member disposed between at least one of the pivoting support members and the respective adjustment member, where the biasing member applies force to the respective adjustment member to maintain the adjustment member in each of the plurality of positions.

Another dunnage conversion machine includes supporting means for supporting a supply of expandable sheet stock material and a pair of expansion members downstream of the supporting means for receiving an expandable sheet stock material therebetween as it is drawn from the supporting means. The expansion members facilitate uniform expansion of the sheet stock material as it is tensioned between the expansion members and a pulling force downstream of the expansion members. An adjustment means is provided for varying a spacing between central longitudinal axes of the expansion members of the pair of expansion members by varying respective positions of sections of differing thickness of the adjustment means relative to one of the central longitudinal axes of the expansion members.

The dunnage conversion machine may further include a support means being pivotable in response to the varying of respective positions of the sections of differing thickness of the adjustment means.

The dunnage conversion machine may further include a biasing means for maintaining a position of the adjustment means relative to the axis of rotation of the one expansion member of the pair of expansion members.

A method of converting an expandable sheet stock material into a relatively less dense dunnage product may include the steps of (a) drawing under tension a first sheet stock material having a first slit pattern from a supply between a pair of rotating members to cause the first sheet stock material to expand in at least one dimension, (b) replacing the first sheet stock material with a second sheet stock material having a second slit pattern different from the first slit pattern, (c) adjusting a spacing between respective axes of rotation of the rotating members, and (d) drawing the second sheet stock material between the pair of rotating members under tension to cause the second sheet stock material to expand in at least one dimension. The adjusting step includes providing tactilely-detectable positions representing at least two different amounts of spacing between the axes of rotation of the rotating members.

The adjusting step may include rotating an eccentric to effect adjusting between the positions.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

BRIEF DESCRIPTION OF THE DRAWINGS

The annexed drawings, which are not necessarily to scale, are being used to help describe aspects of the invention.

DETAILED DESCRIPTION

The present invention generally provides an improved dunnage conversion machine for producing an expanded dunnage product from a supply of unexpanded slit-sheet stock material, and more particularly that facilitates producing expanded dunnage products from supplies of different unexpanded slit-sheet stock material of differing thicknesses, differing pre-slit patterns, or a combination thereof.

The dunnage conversion machine includes a supporting means for supporting a supply of the unexpanded slit-sheet stock material, also referred to as the expandable sheet stock material or the sheet stock material. Unexpanded silt-sheet stock material is a stock material having slits cut therethrough, such that when tension is applied across the slits, the slits will open, sheet material between the slits will rotate out of the original plane of the unexpanded sheet material, and the sheet material will volumetrically expand. The dunnage conversion machine also includes a pair of expansion members downstream of the supporting means for receiving an expandable sheet stock material therebetween as it is drawn from the supporting means, the expansion members facilitating uniform expansion of the sheet stock material as it is tensioned between the expansion members and a pulling force downstream of the expansion members. The downstream direction of the machine, also referred to as the longitudinal direction, is the direction in which stock material travels through the machine from the supporting means to an outlet of the machine, where the upstream direction is oppositely disposed to the downstream direction.

In addition to the supporting means and expansion means, the machine also includes an adjustment means for varying a spacing between central longitudinal axes of the expansion members of the pair of expansion members by varying respective positions of sections of differing thickness of the adjustment means relative to one of the central longitudinal axes of the expansion members. A pivoting means is pivotable in response to positioning of the sections of differing thickness of the adjustment means. Optionally, the dunnage conversion machine may include a biasing means for maintaining a position of the adjustment means relative to the axis of rotation of the one expansion member of the pair of expansion members.

Figure 1:
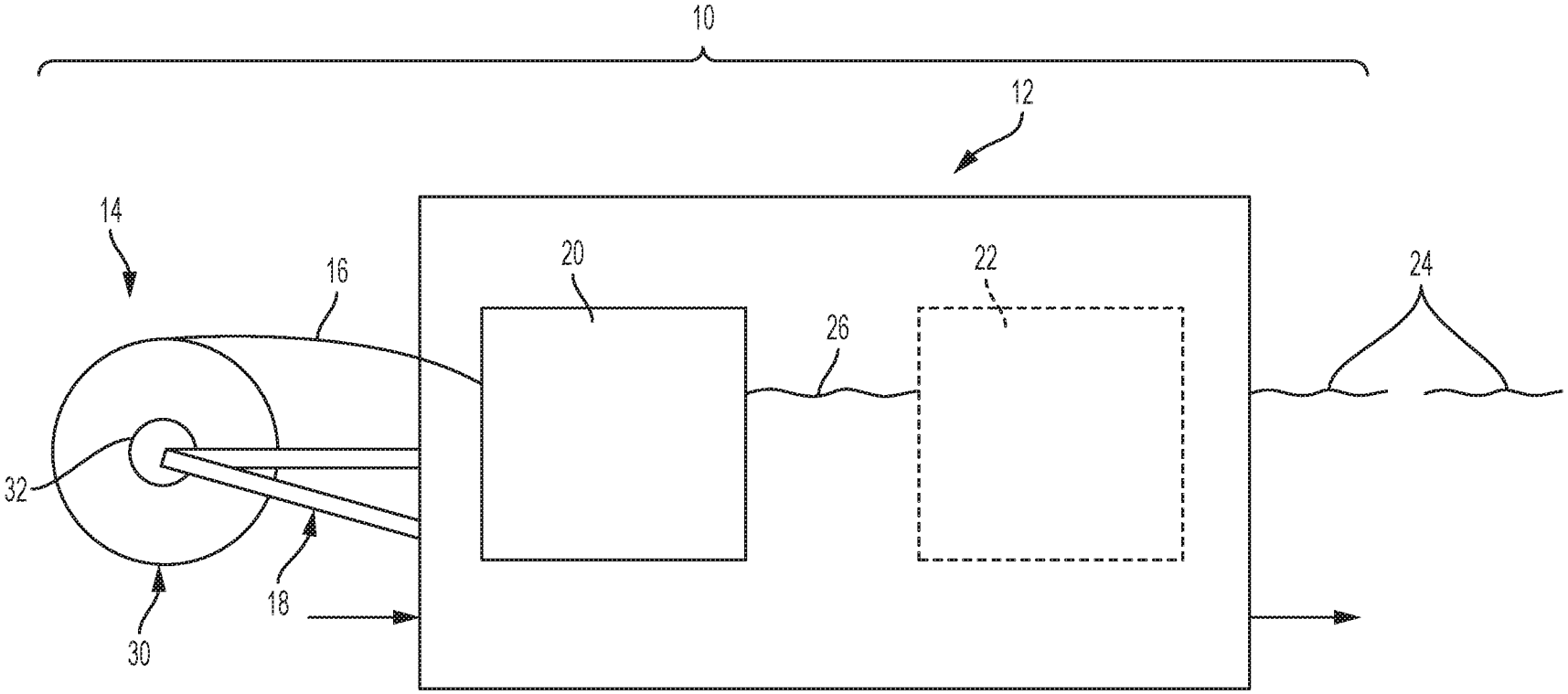
FIG. 1 is a schematic view of an exemplary dunnage conversion machine in accordance with the present invention.

Turning now to the drawings in detail, FIG. 1 schematically illustrates an exemplary dunnage conversion system 10 including both a dunnage conversion machine 12 and a supply 14 of sheet stock material 16. The conversion machine 12, also referred to as an expanding machine, dunnage expanding machine, or converter, enables an operator to produce a more uniformly expanded dunnage product from the supply 14.

The converter 12 includes at least a supporting means 18 for supporting the supply 14 and an expansion assembly 20 for expanding the sheet stock material 16 as it is drawn through the expansion assembly 20. The expansion assembly 20 is disposed downstream of the supply support 18. The converter 12 may optionally include a separating means 22 for severing discrete dunnage products 24 from the continuous strip of expanded dunnage 26 output from the expansion assembly 20. The optional separating means 22 may be disposed downstream of the expansion means 20. The converter 12 optionally may be configured to convert sheet stock material from multiple supplies.

The supply 14 of sheet stock material 16 includes sheet stock material that has been pre-slit and typically includes one or more plies. As shown, the sheet stock material 16, also referred to as sheet material 16, generally is supplied in one or more rolls 30. The sheet material 16 in the roll may be wound about a hollow core 32 that may be received on the supporting means 18, such as an axle that rotates with the hollow core 32, or about which the hollow core rotates, as the sheet material 16 is unwound off the roll. In other embodiments the sheet material 16 may be additionally or alternatively provided in another suitable arrangement, such as in a fan-folded stack, where the material is alternatingly folded into a stack of generally rectangular pages. In the case of a fan-folded stack, a suitable supporting means may include a stand or a cart having a shelf for supporting the fan-folded stack.

Whether in roll form or in the form of a fan-folded stack, the sheet material is generally planar with minimal thickness relative to a width dimension extending between lateral edges, and a length dimension transverse the width dimension. The sheet material typically is drawn from the supply in a feed direction, generally parallel to the length dimension of the sheet material.

An exemplary sheet material 16 is paper, such as kraft paper, and more particularly is a single-ply kraft paper. Suitable kraft paper may have various basis weights, such as twenty-pound or forty-pound, for example. In some embodiments, the sheet material 16 may be laminated or may include any other suitable material such as another paper, plastic sheets, metal foil, or any combination thereof. Paper is an environmentally-responsible stock material that is recyclable, biodegradable, and composed of a renewable resource.

Figure 2:
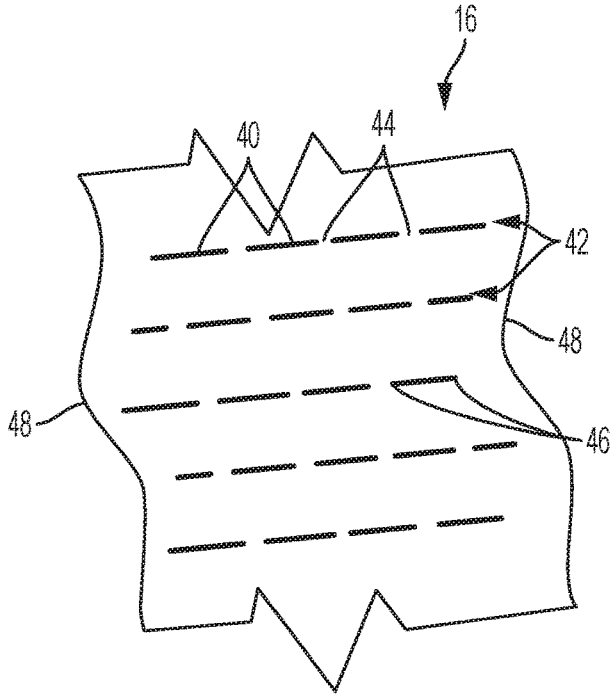
FIG. 2 is a partial plan view of a slit-sheet stock material for use with the exemplary dunnage conversion machine of FIG. 1.
Figure 3:
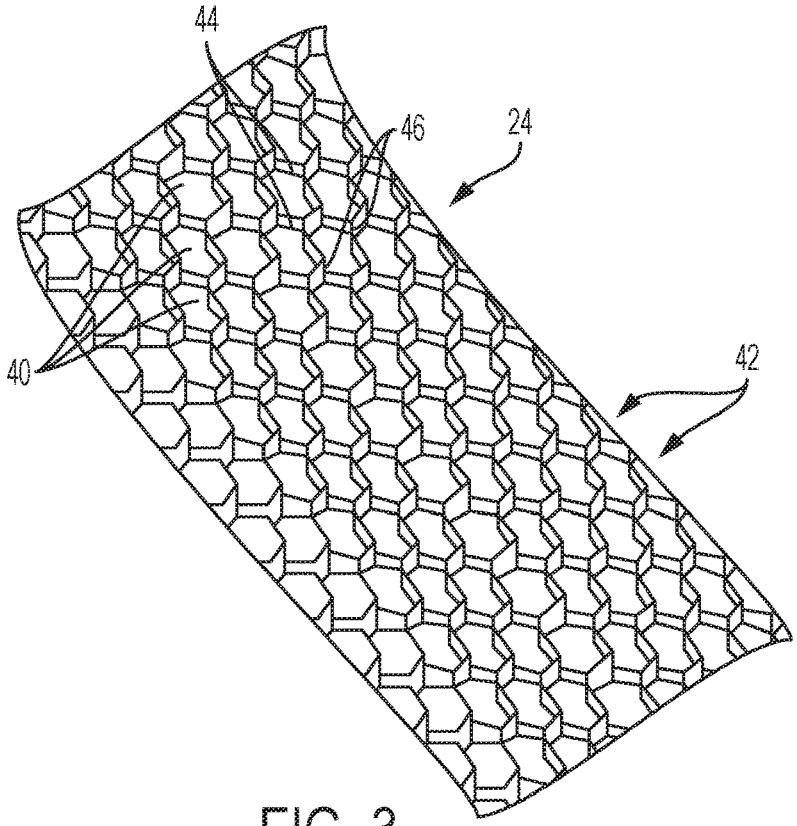
FIG. 3 is a partial perspective view of an expanded dunnage product formed from the slit-sheet stock material of FIG. 2.
Figure 4:
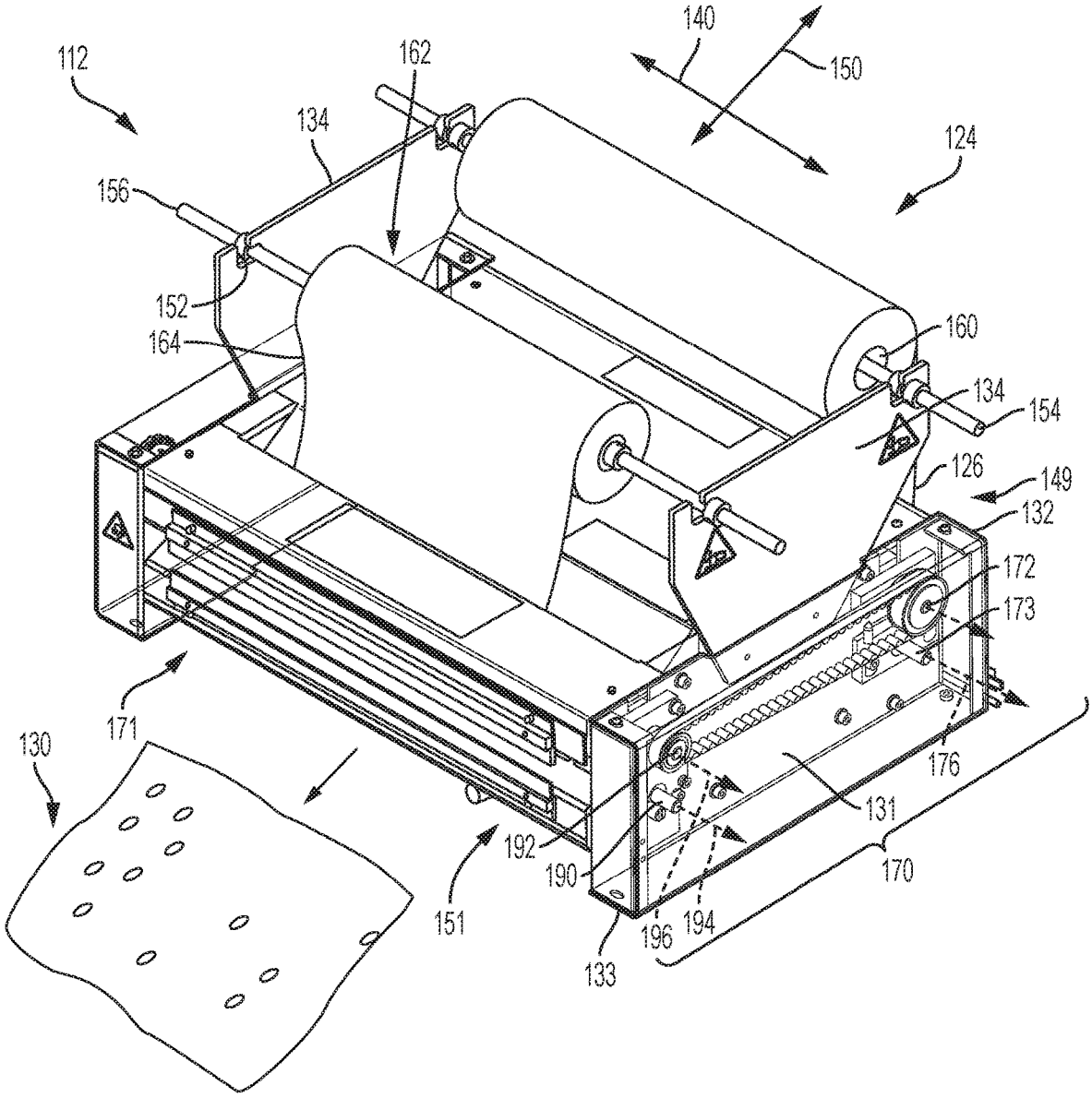
FIG. 4 is a perspective view of an exemplary dunnage conversion machine in accordance with the present invention.
Figure 5:
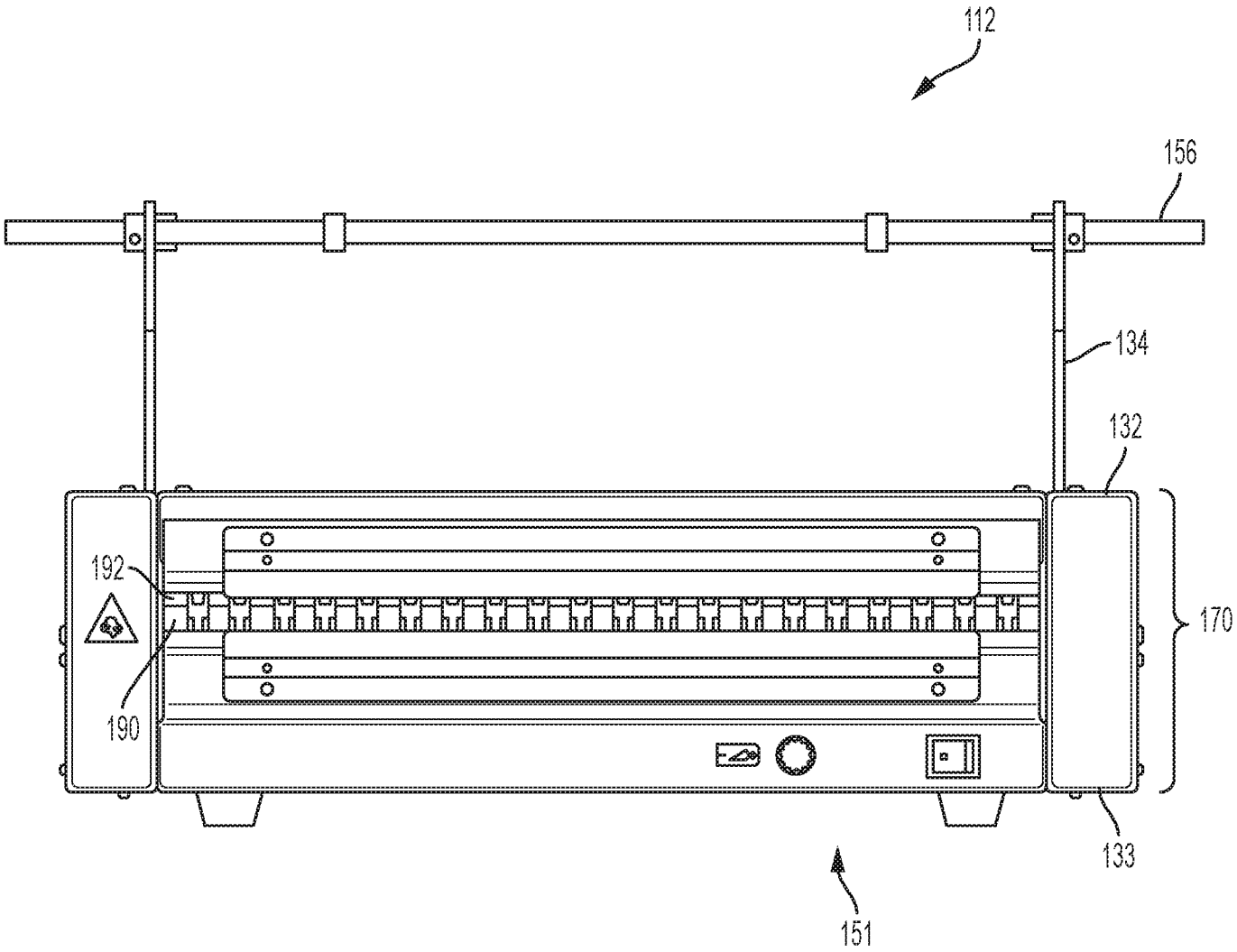
FIG. 5 is a front view of the exemplary dunnage conversion machine of FIG. 4.

Turn now to FIGS. 2 and 3 for further description of the sheet material 16, An exemplary sheet material 16 includes a pre-slit sheet material, also referred to as an unexpanded sheet material or expandable sheet material. The exemplary pre-slit sheet material includes a plurality of slits 40 arranged in a plurality of longitudinally-spaced, transversely-extending rows 42 of slits 40 arranged across the width of the sheet material. The pre-slit sheet stock material 16 may have any of many alternative arrangements of slits and/or a differing sheet thickness. Different arrangements of slits may include any one or more of different arrangements of rows relative to one another, differently sized slits, different spacing between slits, different slit shape or slit positioning, such as angular positioning, relative to adjacent slits, etc. The slits may be formed by cutting the sheet material, or otherwise by weakening the sheet material, intermittently across the sheet material.

The rows 42 of slits 40 generally are parallel to one another and are generally periodically, and typically equally, longitudinally-spaced from one another. The slits 40 are intermittently dispersed across the rows 42, with the slits 40 of each row 42 generally being staggered in relation to slits 40 of directly adjacent rows 42. Across each row 42 of slits 40, there may be a greater length of combined slits 40 than a length of un-slit portions 44 disposed between laterally-opposed slit endpoints 46, providing for an optimum amount of expansion of the slit sheet material 16.

The slit sheet material 16 is configured to expand in one or more dimensions, also referred to as volume expansion or volumetric expansion, as the sheet material 16 travels through the converter 12 (FIG. 1). When the sheet material 16 is stretched under tension applied in a direction transverse the direction of the slits, typically in a longitudinal feed direction, perpendicular to a width dimension of the roll of sheet material 16, the paper's longitudinal length and its thickness increase, while the paper's lateral width dimension decreases. The increased thickness as the sheet material 16 is stretched longitudinally is caused at least in part by portions of the sheet material 16 between the rows of slits rotating relative to the plane of the unexpanded sheet material 16. The thickness dimension extends in a normal direction relative to a face of the sheet material. The normal direction is defined as generally orthogonal to the paper's longitudinal length and also generally orthogonal to a lateral extent between laterally-opposed edges 48 of the sheet material, i.e., the width. The thickness of a slit sheet material 16 can be increased by an order of magnitude, or more, relative to its original thickness when stretched in this manner.

The expanded slit sheet material, in the form of the continuous strip of expanded dunnage 26 (FIG. 1), has an increased length and thickness and reduced width as compared to the unexpanded slit sheet material 16. This longitudinal stretching and increase in thickness results in the volumetrically expanded dunnage product 24 (FIGS. 1 and 3), and is effected by the un-slit portions 44 between slits 40 and of the paper at the upstream and downstream sides of the slits 40 separating from adjacent portions of sheet material across the slits and rotating out of the plane of the unexpanded sheet material. The increased volume allows the expanded dunnage product 24 to serve as a perforate protective void-fill or cushioning wrap for packaging articles in containers.

Turning now to FIGS. 4-13, an exemplary converter 112 for expanding pre-slit sheet stock materials will be further described in the following paragraphs. The converter 112, cooperates with a supply 124 of expandable slit sheet stock material 126 to produce a resultant expanded slit sheet packaging material, i.e., an expanded dunnage product 130.

The converter 112 generally includes a housing, which includes a frame 132. The illustrated frame 132 includes opposing, laterally-spaced side panels 131 coupled to one or more base panels 133 for resting on a work surface, such as a table. Coupled to the frame 132, such as to the side panels 131, are one or more means for supporting sheet material, such as one or more supply supports 134. In the illustrated converter 112, a pair of opposing laterally-spaced supply supports 134 are respectively coupled to the pair of side panels 131. The supply supports 134 are spaced apart in a lateral direction 140. The lateral direction 140 extends transverse a longitudinal direction 150 extending from a rear 149 of the frame 132 to a front 151 of the frame 132 having an outlet for dispensing of expanded dunnage. The longitudinal direction 150 is parallel the feed direction of the sheet stock material through the converter 112.

A pair of axles 154 and 156 are supported by the supply supports 134, such as in notches 152 of the supply supports 134 as shown. The rearmost axle 154 is positioned for supporting the supply 124 of expandable sheet stock material 126, and may receive and support a core 160 of a roll of sheet material in the expandable supply 124. The forwardmost axle 156 is positioned for supporting a supply 162 of separator material 164, which may include an interleaf paper. The separator material 164 may be a tissue paper, thin kraft paper such as thinner than the expandable sheet stock material, plastic, a combination thereof, etc. Like the supply 124 of expandable sheet stock material 126, the separator supply 162 may be provided as a roll, such as wound about a hollow core that may be received on the axle 156. Additionally or alternatively, the separator supply 162 may be provided in a fan-folded stack, and an associated supply support may include a shelf for supporting the stack.

Figure 6:
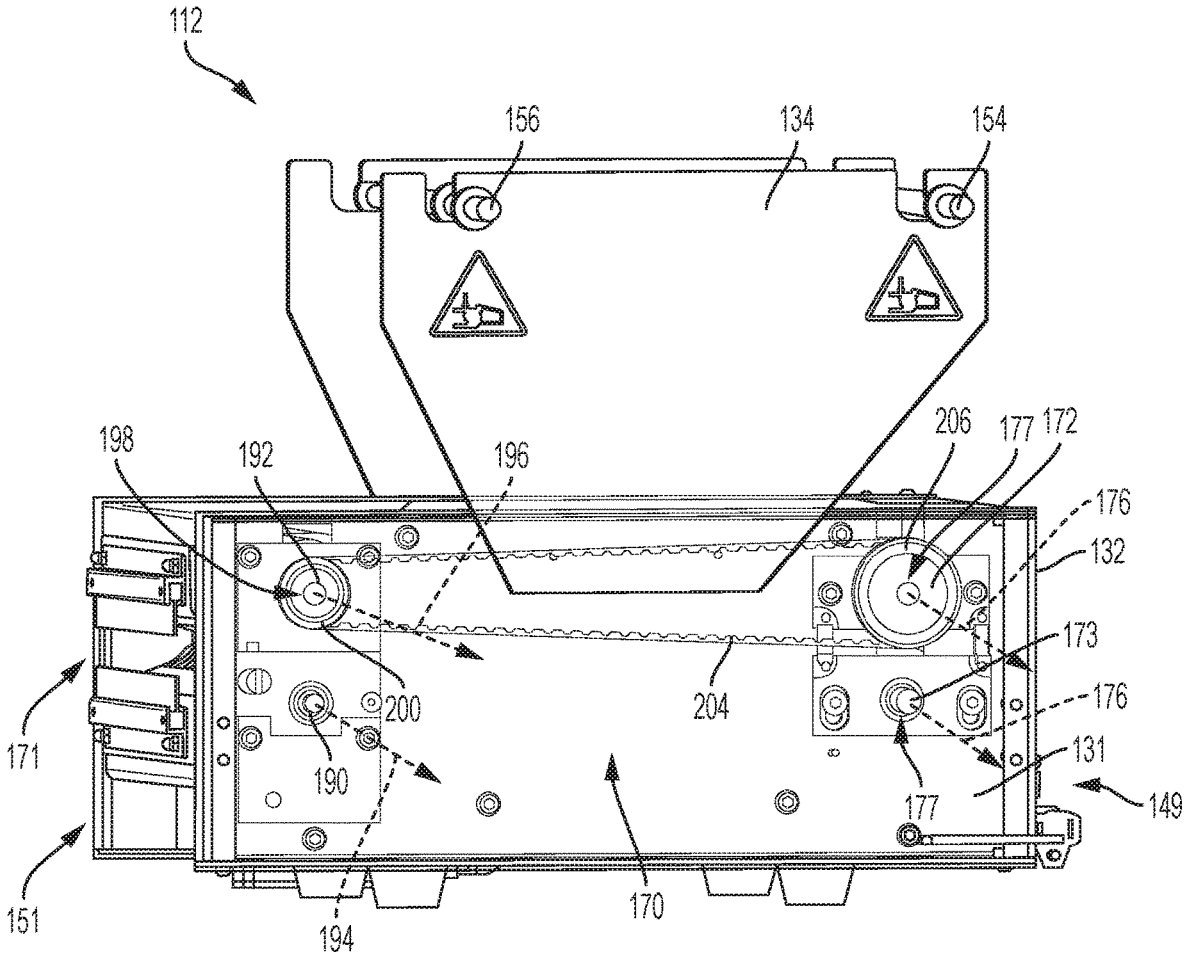
FIG. 6 is a side view of the exemplary dunnage conversion machine of FIG. 4.
Figure 7:
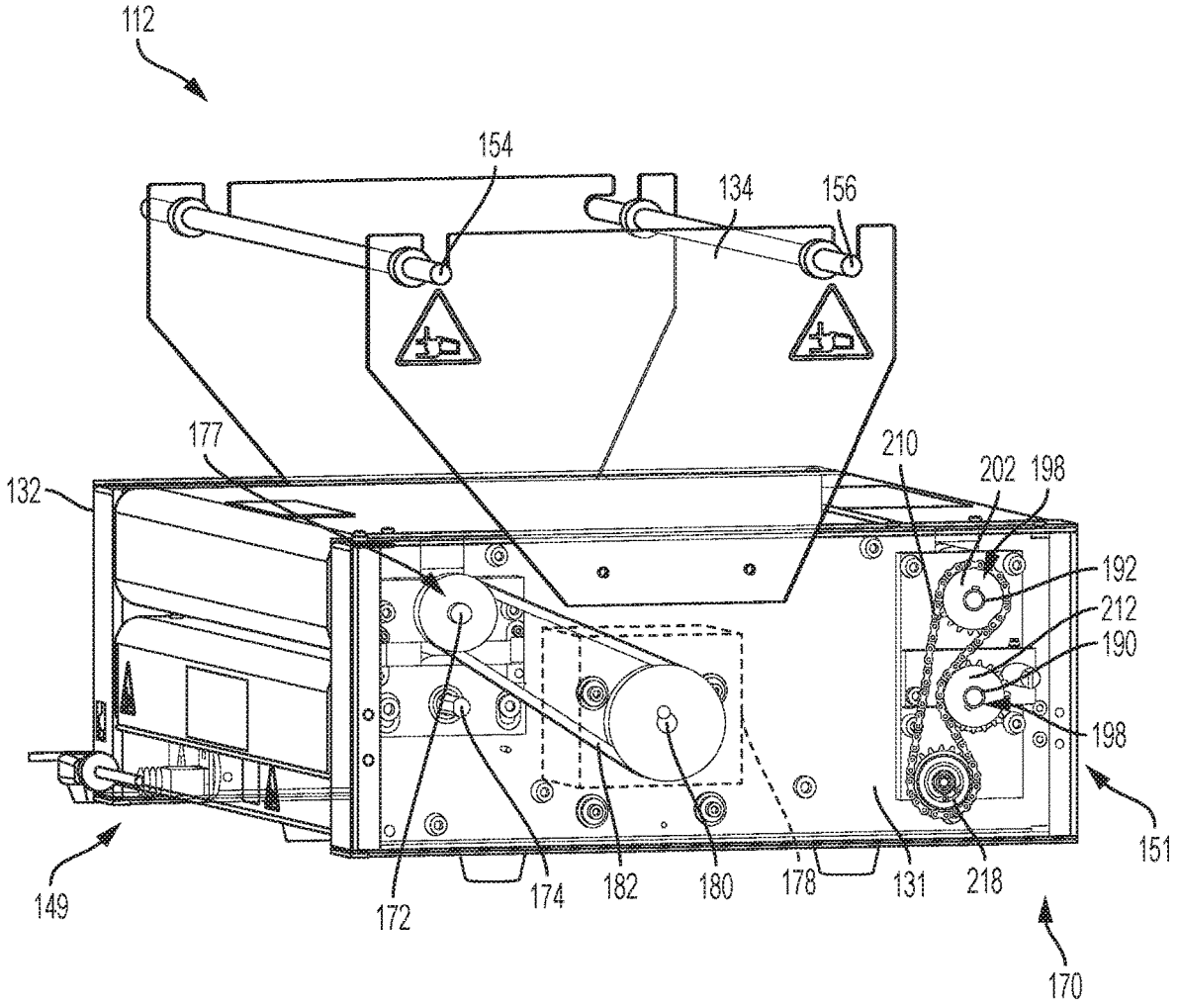
FIG. 7 is a side view of the exemplary dunnage conversion machine of FIG. 4, showing the side opposite that shown in FIG. 6.

Referring in particular to FIGS. 6 and 7, the converter 112 also provides a means for gripping the expandable sheet stock material 126 as it is drawn from the supply 124 includes an expansion assembly 170. The expansion assembly 170 is spaced downstream of the one or more supply supports 134. The downstream direction is equivalent to the feed direction, and follows the path of the expandable sheet stock material 126 from the supply 124 to an outlet 171 of the dunnage conversion machine 112.

The illustrated expansion assembly 170 includes a pair of tensioning members 172 and 173 that receive and grip the unexpanded sheet stock material 126 drawn from the supply 124. The expandable sheet stock material 126 extends between the pair of tensioning members 172 and 173. The tensioning members 172 and 173 are positioned downstream of the rearmost axle 154 and are rotatably coupled to the side panels 131 of the frame 132 for rotation about respective axes of rotation 176. As depicted, opposed lateral ends 177 of each of the tensioning members 172 and 173 are received in the side panels 131, though other means of support may be appropriate.

At least one of the tensioning members 172 and 173 may be powered by a suitable motor 178. The motor 178 drives rotation of a force transfer axle 180 to which the first driven tensioning member 172 is coupled by a suitable force transfer member 182 (FIG. 7), such as a belt or chain, which may be toothed in some embodiments. In some embodiments, the second tensioning member 173 may be driven, or both tensioning members 172 and 173 may be driven, such as in the same or opposing directions.

Downstream of the supply supports 134 and of the pair of tensioning members 172 and 173, is a pair of expansion members 190 and 192. The pair of expansion members 190 and 192 are longitudinally-spaced from the pair of tensioning members 172 and 173. The pair of expansion members 190 and 192 are spaced apart from one another to enable receipt of the sheet stock material 126 therebetween.

Particularly, the depicted pair of expansion members 190 and 192 are positioned to grip the expanded form of the sheet stock material 126, i.e., a continuous strip of expanded dunnage. Tension to expand the expandable sheet stock material 126 from an unexpanded form to the expanded form of the continuous strip of dunnage is provided between the pair of tensioning members 172 and 173 and the pair of expansion members 190 and 192.

Turning to specifics of the expansion members 190 and 192, the first expansion member 190 and the second expansion member 192 are rotatably coupled to the side panels 131 of the frame 132. The expansion members 190 and 192 are coupled for rotation about parallel respective first and second axes of rotation 194 and 196. As depicted, opposed lateral ends 198 of each of the expansion members 190 and 192 are received in the side panels 131, though other means of support may be appropriate.

The second expansion member 192 is an upper expansion member located above the first expansion member 190. The opposed lateral ends 198 of the second expansion member 192 include respective rotating members 200 and 202 coupled thereto for allowing driving of each of the first and second expansion members 190 and 192. The rotating member 200 is a pulley wheel, such as a toothed pulley wheel, for receiving a transfer member 204 (FIG. 6), such as a belt or chain, which may be toothed. The transfer member 204 extends between a suitable rotating member 206, such as a pulley wheel coupled to a lateral end 177 of the first driven tensioning member 172. The transfer member 204 enables joint rotation of the first driven tensioning member 172 and the second expansion member 192, such as in the same direction, by the motor 178.

On the opposed side of the converter 112, the rotating member 202, such as a toothed gear, receives a transfer member 210 (FIG. 7), such as another belt or chain, which may be toothed. The transfer member 210 is received at each of the rotating member 202 and a rotating member 212, such as a toothed gear. The rotating member 212 is coupled to the respective lateral end 198 of the first expansion member 190 for allowing joint rotation of the first expansion member 190 with the second expansion member 192. A supplemental support rotating member 218, such as another toothed gear, is further rotationally coupled to the respective side panel 131 adjacent the gears 202 and 212 for providing support to the transfer member 210. As depicted, the expansion members 190 and 192 rotate in opposite directions.

Together, the transfer members 182, 204, and 210 provide rotational intercoupling of the respective first driven tensioning member 172 and the expansion members 190 and 192. Accordingly, the motor 178 is configured to drive the first tensioning member 172 and each of the first expansion member 190 and the second expansion member 192.

In other embodiments, an alternative construction may enable any of: (i) rotation of the second expansion member 192 in an opposite rotational direction relative to the first tensioning member 172, (ii) rotation of the first and second expansion members 190 and 192 in the same direction, or (iii) alternative or additional driving of the first expansion member 190 by the motor 178. In even other embodiments, neither of the first and second expansion members 190 and 192 may be driven, and tension at the outlet 171 of the converter 112 may be provided manually, such as by a user. In still other embodiments, the tensioning members 172 and 173 may be omitted altogether, and tension to expand the sheet stock material 126 may be provided between the supply 124 and one of the pair of expansion members 190 and 192, an externally applied force, or a manually applied force.

Figure 8:
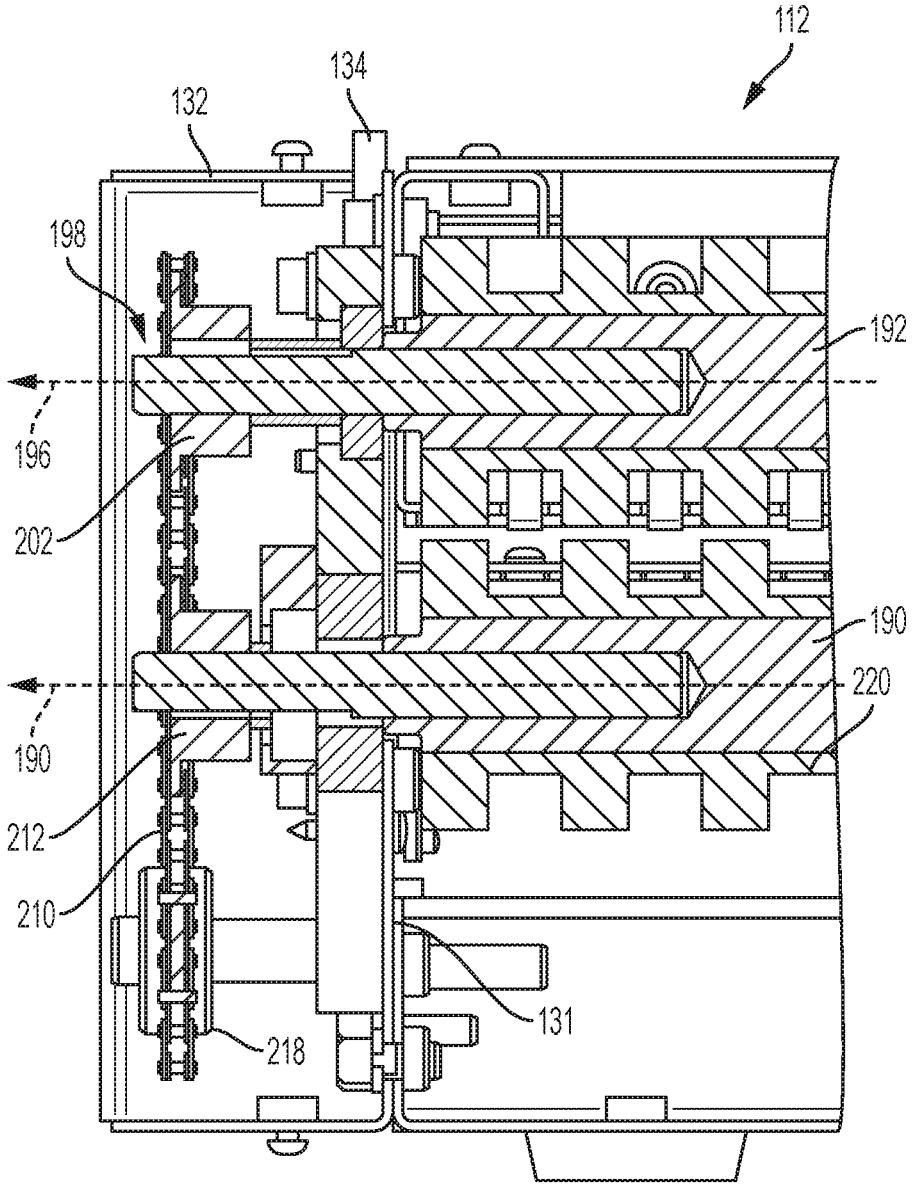
FIG. 8 is a partial cross-section of the exemplary dunnage conversion machine of FIG. 4, with the cross-section taken through the expansion assembly.

The tensioning members 172 and 173 and/or the expansion members 190 and 192 may include features that assist in maintaining the ability to apply tension to and feed the sheet stock material, expanded or unexpanded. As shown in FIG. 8, to maintain grip on the expanded form of the sheet stock material being expanded between the tensioning members 172 and 173 and the expansion members 190 and 192, the illustrated expansion members 190 and 192 include a plurality of gripping members 220. The gripping members 220 are configured to maintain tension on the expanded form of the sheet stock material, also referred to as the continuous strip of expanded dunnage (not shown), such that tearing, crushing, and/or jamming of the strip of expanded dunnage is prevented or minimalized. The gripping members 220, such as teeth, of each of the respective expansion members 190 and 192 are laterally-spaced apart from one another. The depicted gripping members 220 expend fully circumferentially about the expansion members 190 and 192 and are equally laterally spaced apart from one another. The depicted gripping members 220 of the first expansion member 190 are laterally aligned at the same respective lateral positions between the opposed lateral ends 198 as the gripping members 220 of the second expansion member 192. Alternative spacings, arrangements, shapes, and/or sizes of gripping members may be suitable in other embodiments.

Figure 9:
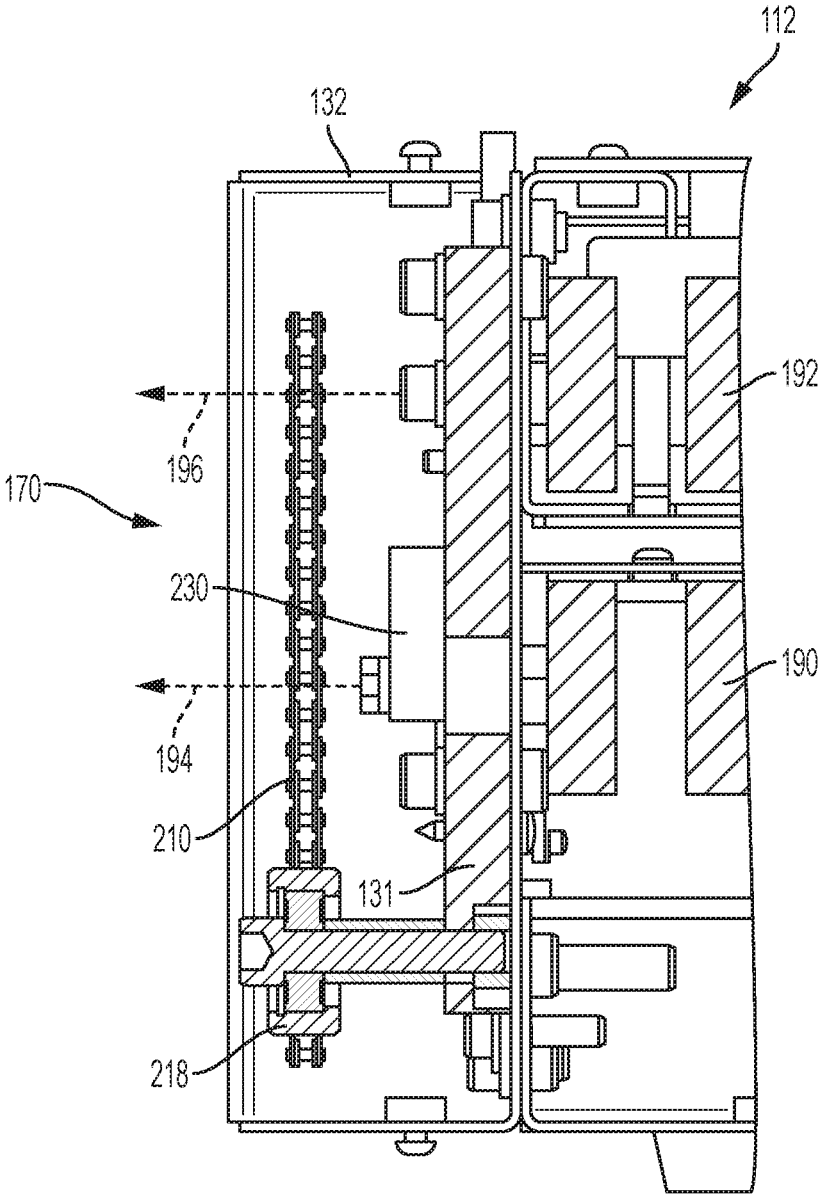
FIG. 9 is a partial cross-section of the exemplary dunnage conversion machine of FIG. 4, with the cross-section taken through the expansion assembly.
Figure 10:
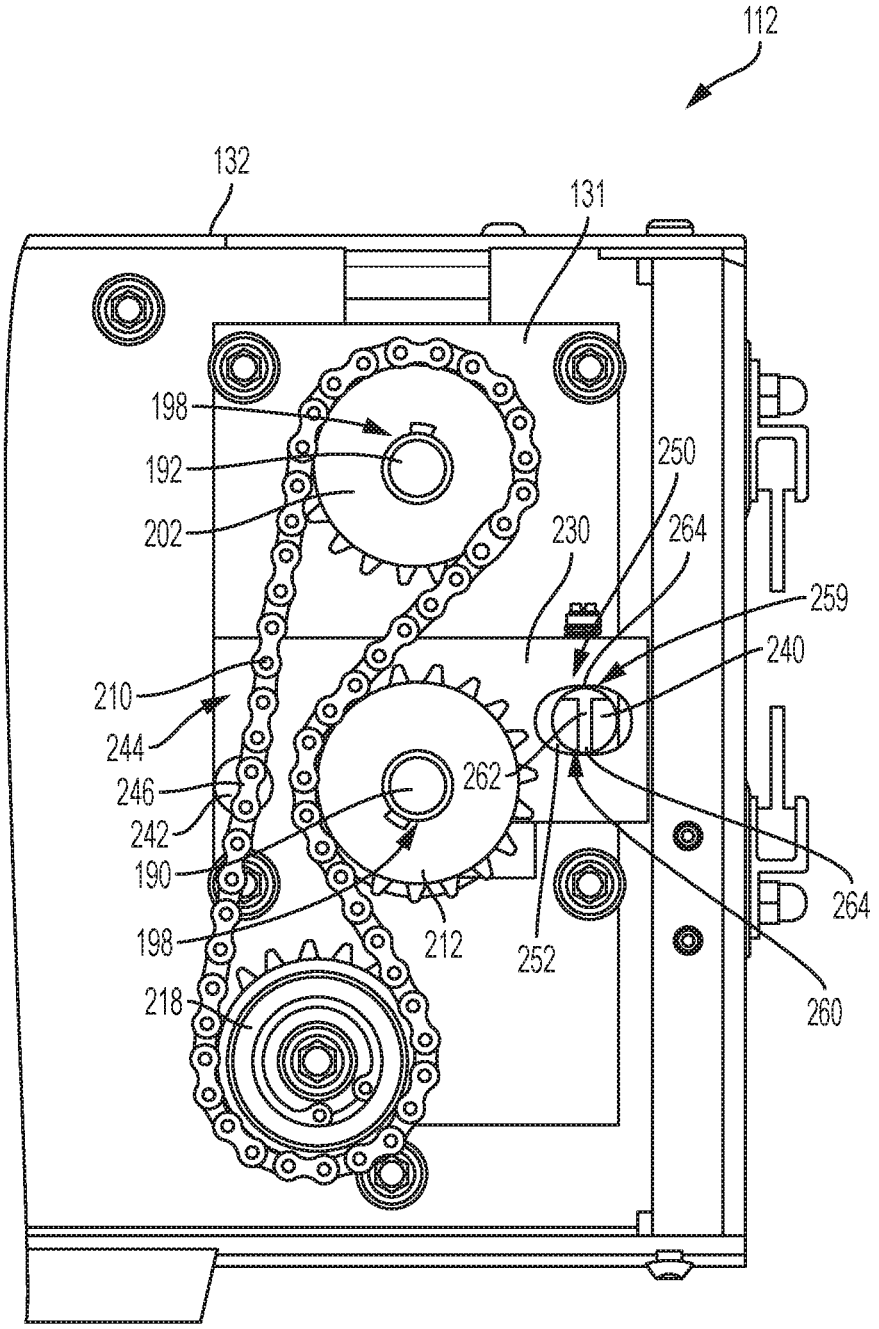
FIG. 10 is a side view of the exemplary dunnage conversion machine of FIG. 4, with part of the external housing removed and the expansion assembly shown in a primary position.
Figure 11:
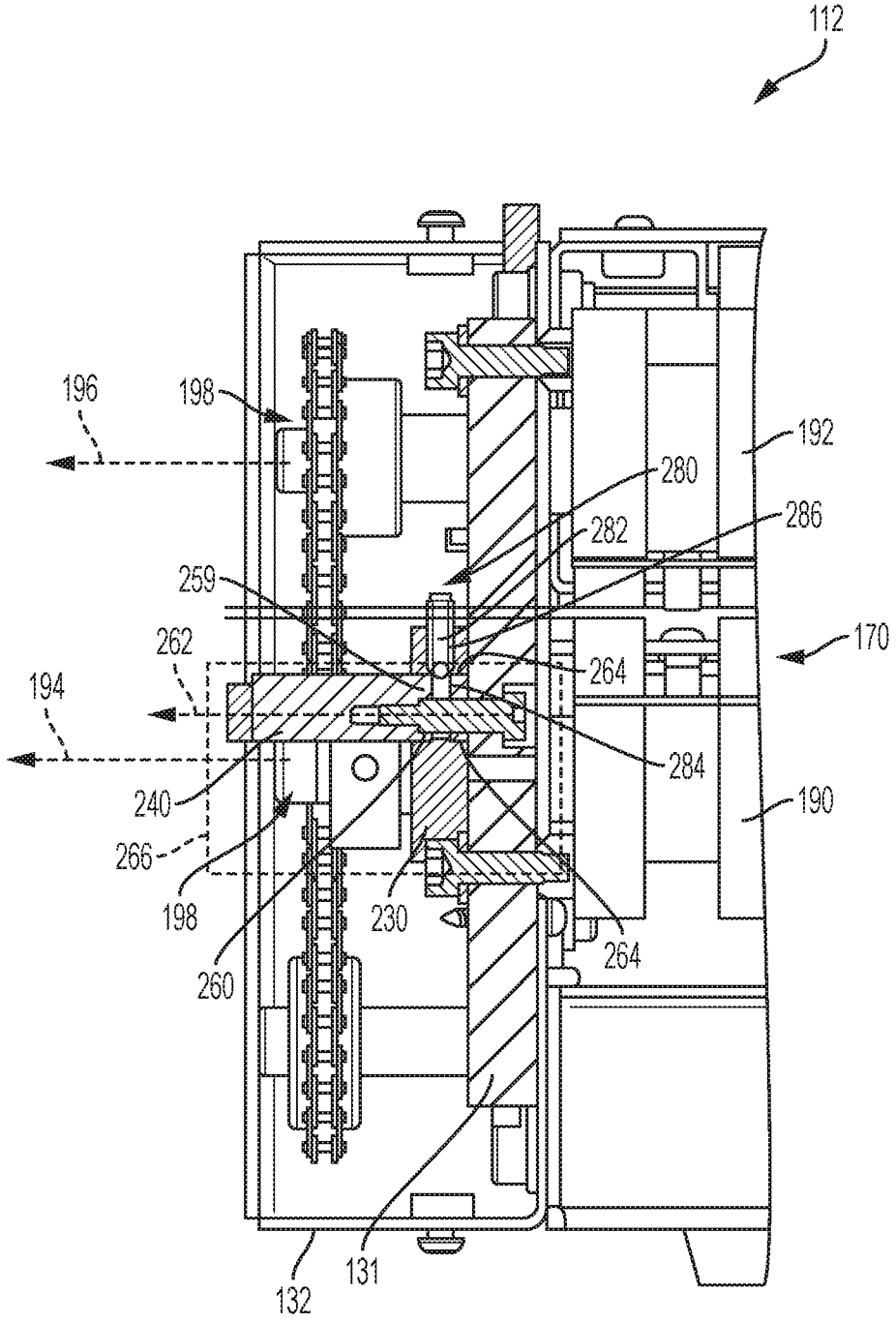
FIG. 11 is a partial cross-section of the exemplary dunnage conversion machine of FIG. 4, with the cross-section taken through the expansion assembly and the expansion assembly shown in a primary position.

Referring now to FIGS. 9-11, spacing between the rotational axes 194 and 196 of the expansion members 190 and 192 is controlled to prevent or minimalize this tearing, crushing, and/or jamming via support members 230 of the expansion assembly 170 and by an adjustment means, such as one or more adjustment members 240 of the expansion assembly 170. The spacing may be adjusted to accommodate strips of expanded dunnage having differing volumetric dimensions, such as where differing unexpanded sheet materials have different thicknesses and/or different slit arrangements.

A set of opposed, laterally-spaced support members 230 are pivotably coupled to the respective side panels 131 of the frame 132. The support members 230 support the lateral end portions 198 of the first expansion member 190 such that pivoting movement of the support members 230 changes a position of the first axis of rotation 194 of the first expansion member 190 relative to the second axis of rotation 196 of the second expansion member 192. For example, the lateral end portions 198 of the first expansion member 190 are received through the support members 230. A fastener 242 couples one longitudinal end 244 of each support member 230 to the respective side panel 131. The support members 230 pivot about the fasteners 242 and about a pivoting axis 246 extending through the fasteners 242.

The adjustment means is selectively positionable to cause movement of the support members 230, and thereby to change the position of the first axis of rotation 194 relative to the second axis of rotation 196. Moreover, the adjustment means is adjustable such that the parallel relationship between the first and second axes of rotation 194 and 196 is maintained at each of a plurality of positions of the adjustment means.

In alternative embodiments, the support members 230 may be integral with one another, such as being connected via a support extending laterally between the support members 230. Additionally or alternatively, a single adjustment member 240 may provide for pivoting adjustment of the support member(s), where the single adjustment member 240 may extend laterally between the support member(s).

As illustrated, opposed longitudinal ends 250 of at least one of the support members 230 are supported by an adjustable adjustment means. As illustrated, the opposed longitudinal ends 250 of each of the support members 230 are supported by a respective adjustment member 240. The adjustment member 240 is received in an adjustment orifice 252 of the respective support member 230. The illustrated lateral end portions 198 of the first expansion member 190 are disposed longitudinally between the fasteners 242 and the adjustment members 240. In some embodiments, the adjustment members 240 may be longitudinally disposed between the lateral end portions 198 of the first expansion member 190 and fasteners 242.

Referring now to one of the adjustment members 240, but equally applicable to each of the adjustment members 240, the adjustment member 240 is coupled, such as rotatably coupled, to the frame 132, such as to the respective side panel 131. The adjustment member 240 is selectively adjustable, such as manually, between any of a plurality of positions effecting pivoting of the support member 230. The positions are each predetermined and tactilely-detectable in view of the adjustment member 240 having a plurality of sections of differing thickness.

The adjustment member 240 is coupled to the respective pivoting support member 230 such that selective positioning in any of the plurality of positions of the adjustment member 240 causes the sections of differing thickness to be interchangeably positionable relative to the first axis of rotation 194. The interchangeable positioning adjusts the position of the respective pivoting support member 230 in any of a plurality of positions of the respective pivoting support member 230. The interchanging of the sections of differing thickness thereby causes changing of the position of the first axis of rotation 194 relative to the second axis of rotation 196.

Particularly, the sections of differing thickness are circumferentially spaced apart, such as equally spaced apart, about a circumference of the adjustment member 240. The adjustment member 240 is rotatable about an adjustment axis 262 relative to the frame 132 to change the positioning of the sections of differing thickness relative to the frame 132. This is accomplished by creating an eccentric—offsetting the adjustment axis 262 about which the adjustment member 240 rotates from a centerline of the adjustment member 240.

As depicted, a pair of opposing sections of differing thickness 259 and 260, one being thicker than the other, are defined by a spacing between the adjustment axis 262 and a radially outer point 264 of each of the sections of differing thickness 259 and 260. The sections 259 and 260 each have a different thickness in view of the adjustment member 240 being an eccentric where the adjustment axis 262 is offset from a central longitudinal axis of the adjustment member 240. The thickness dimension of each of the sections of differing thickness 259 and 260 extends along a plane 266 (FIG. 11) that is disposed orthogonal to the first axis of rotation 194. In other embodiments, the adjustment member 240 may include any suitable number of sections of differing thickness 259 and 260 and/or the sections of differing thickness 259 and 260 may be otherwise spaced from one another about the adjustment member 240.

Figure 13:
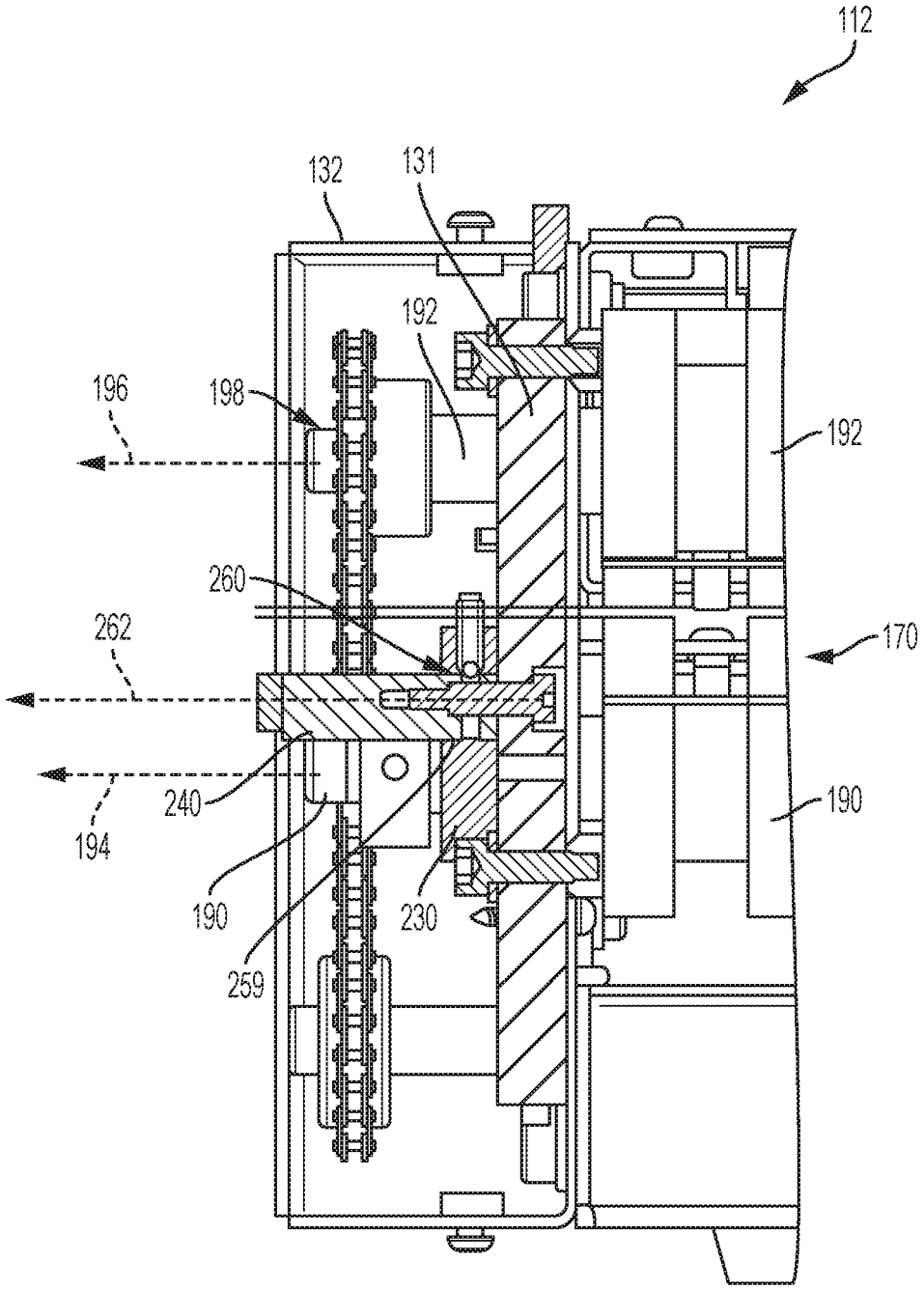
FIG. 13 is a partial cross-section of the exemplary dunnage conversion machine of FIG. 4, with the cross-section taken through the expansion assembly and the expansion assembly shown in a secondary position.

Eccentric rotation of the adjustment member 240 about the adjustment axis 262 causes the positionable sections of differing thickness 259 and 260 to be interchangeably positionable between an orientation with an upwardly-facing thicker portion 259 (FIG. 11) and an orientation with an upwardly-facing thinner portion 260 (FIG. 13). Only one section 259, 260 of differing thickness at a time can occupy an upwardly-facing acting position. At least a portion of the support member 230 is disposed between an upwardly-facing portion and the first axis of rotation 194 to cause lifting or lowering pivoting movement of the support member 230. To allow for the interchangeable positioning, the adjustment orifice 252 is configured, such as having an elliptical or oblong shape to accommodate the eccentric rotation of the adjustment member 240 about the offset adjustment axis of rotation 262.

Figure 12:
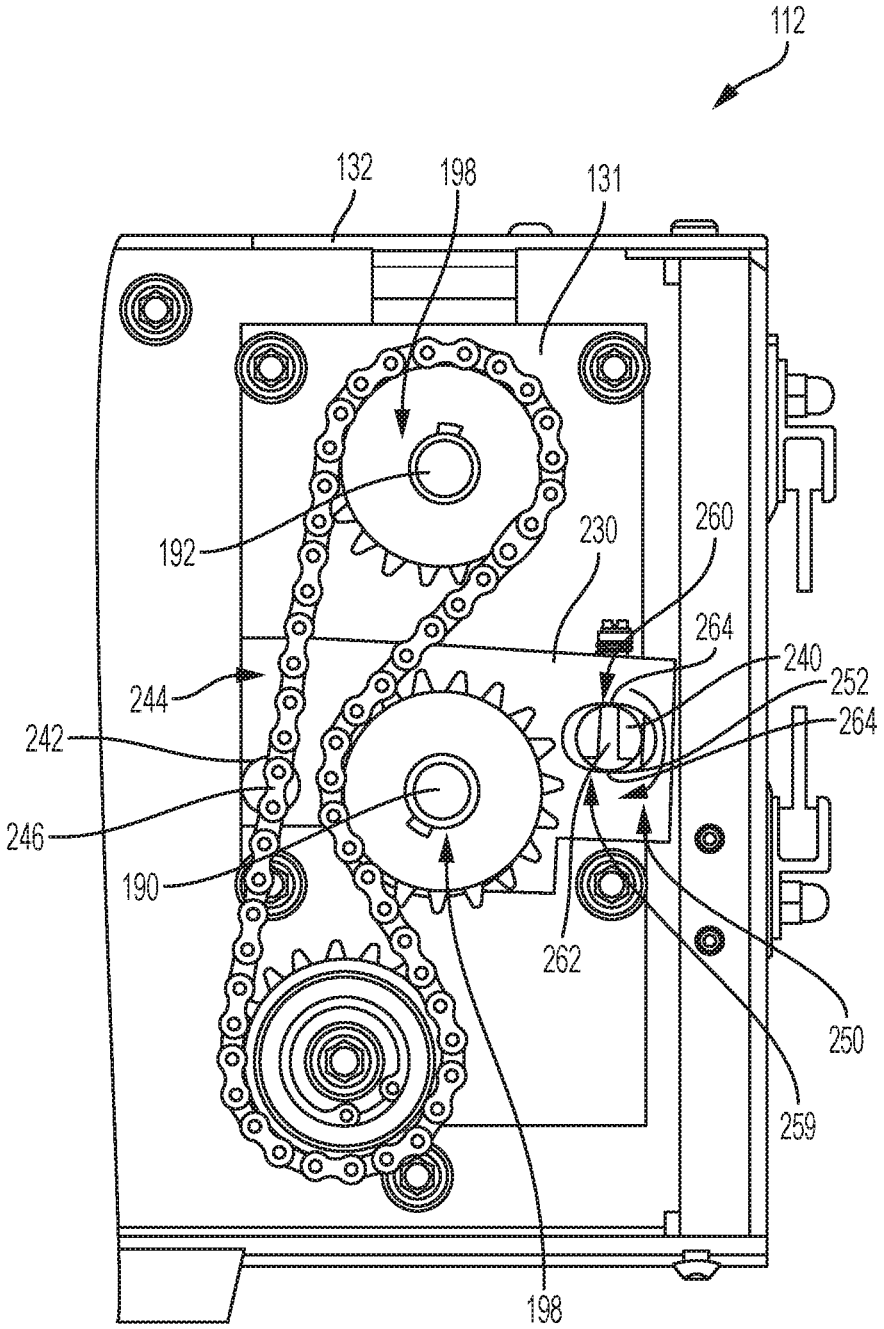
FIG. 12 is a side view of the exemplary dunnage conversion machine of FIG. 4, with part of the external housing removed and the expansion assembly shown in a secondary position.

For example, looking first to FIGS. 10 and 11, the adjustment member 240 is provided in a default position. The thicker section 259, shown best in the cross-section of FIG. 11, is positioned in the upwardly-facing acting position. The adjustment member 240 may be rotated such that the opposing less-thick (thinner) section 260 may be interchangeably rotated into the upwardly-facing acting position, as shown in FIGS. 12 and 13, while the thicker section 259 is rotated into a lower non-acting position, or downwardly-facing non-acting position, opposite the upwardly-facing acting position. In particular, each of the opposing adjustment members 240 is identically adjusted to maintain for uniform gripping across an expanded sheet stock material extending between the first and second expansion members 190 and 192. In this secondary position of the adjustment members 240, the respective support members 230 are downwardly pivoted towards the base panel 230. The secondary position of the adjustment members 240 shown in FIGS. 12 and 13 provides for an increased spacing between the first and second axes of rotation 194 and 196 of the first and second expansion members 190 and 192 than is provided by the default position of the adjustment members 240 shown in FIGS. 9-11.

Turning again briefly to FIG. 11, the adjustment member 240 is maintained in each of the default and secondary positions by a biasing means. The biasing means, such as opposed spring plungers 280, prevent rotation of the adjustment member 240. The spring plungers 280 are generally disposed between the pivoting support members 230 and the respective adjustment members 240.

More particularly, a spring plunger 280 is coupled to each of the support members 230 for engaging with the respective adjustment members 240. Each spring plunger 280 includes a plunger 282 received into the respective support member 230 and into a plunger orifice 284 extending between the pair of sections of differing thickness 260 of the respective adjustment member 240. A biasing member 286, such as a coil spring, maintains the plunger 282 into engagement in the plunger orifice 284. The plunger orifice 284 may be configured, such as having tapered portions, such that the plunger 282 is automatically eased out of one side of the plunger orifice 284 located at one of the sections of differing thickness 260 and into engagement into the opposite side of the plunger orifice 284 located at the other of the pair of sections of differing thickness. In some embodiments, the plunger orifice 284 may not extend fully through the adjustment member 240, and thus opposed plunger orifices may be provided to provide similar function. In some embodiments including only a single adjustment member 240, one or two spring plungers 280 may be used.

Turning now to FIGS. 14-17, another embodiment of an exemplary dunnage conversion machine is illustrated at 312. The exemplary dunnage conversion machine 312 is substantially the same as the above-referenced dunnage conversion machine 112, and consequently the same reference numerals but indexed by 200 are used to denote structures corresponding to similar structures in the dunnage conversion machine 312. In addition, the foregoing description of the dunnage conversion machine 112 is equally applicable to the dunnage conversion machine 312 except as noted below, and particularly with respect to the adjustment means of the dunnage conversion machine 312. Moreover, it will be appreciated upon reading and understanding the specification that aspects of the dunnage conversion machines 112 and 312 may be substituted for one another or used in conjunction with one another where applicable.

Figure 14:
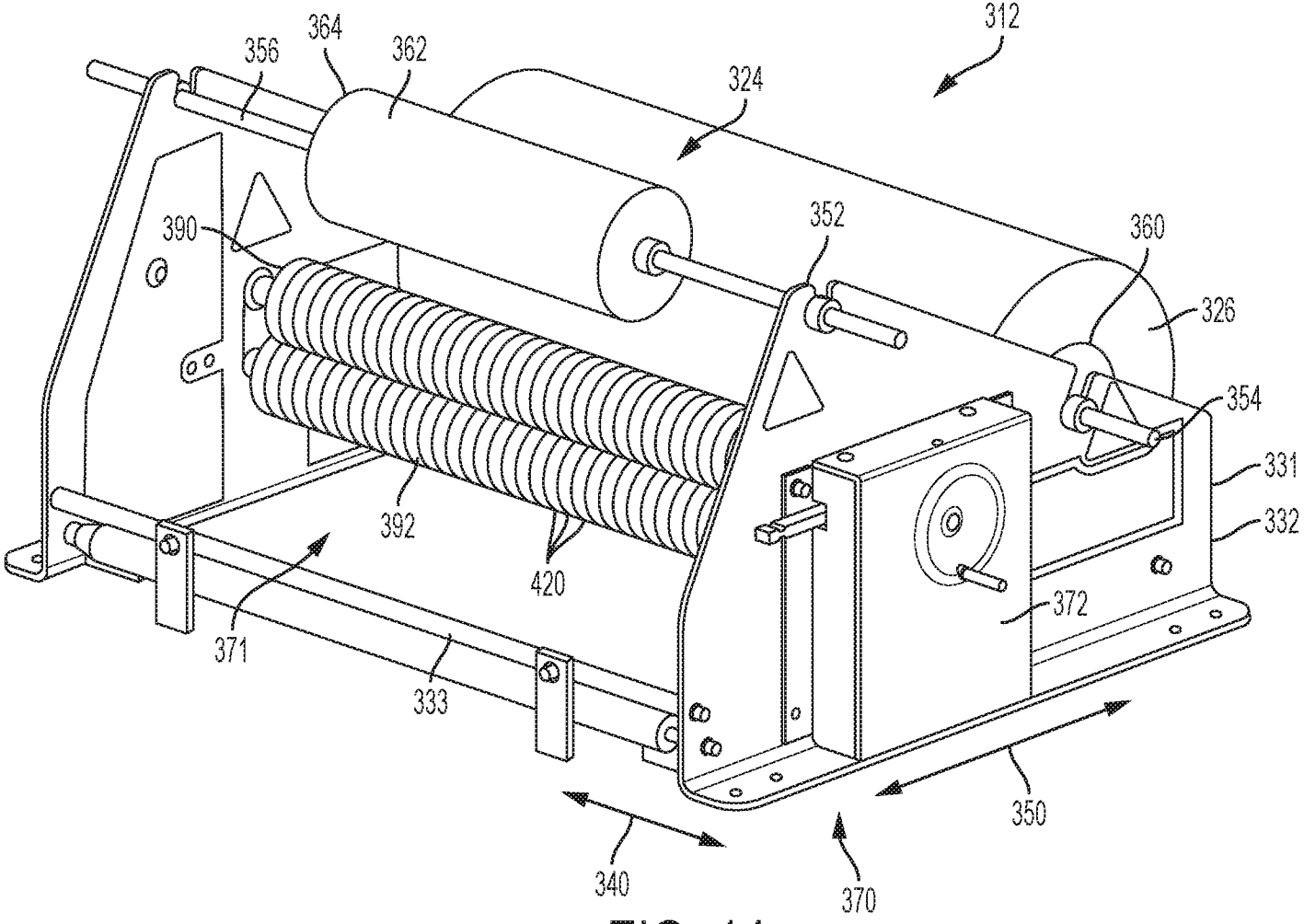
FIG. 14 is a perspective view of another exemplary dunnage conversion in accordance with the present invention.
Figure 15:
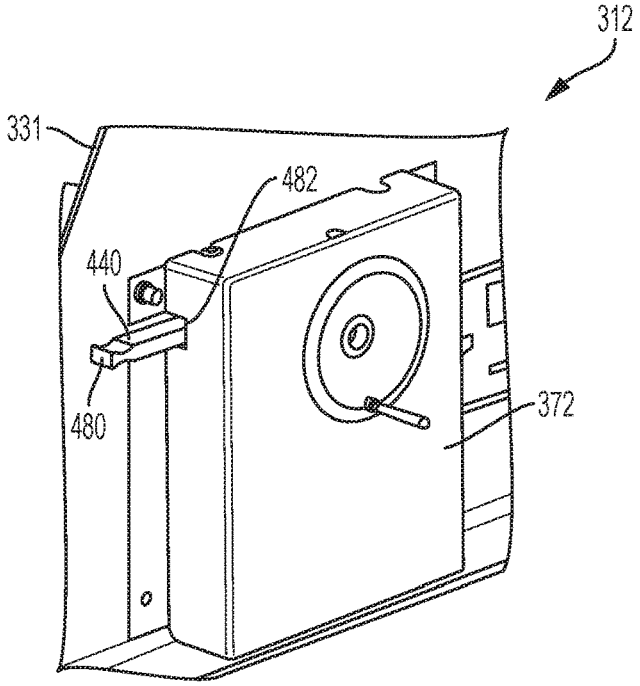
FIG. 15 is a partial side view of the exemplary dunnage conversion machine of FIG. 14.
Figure 16:
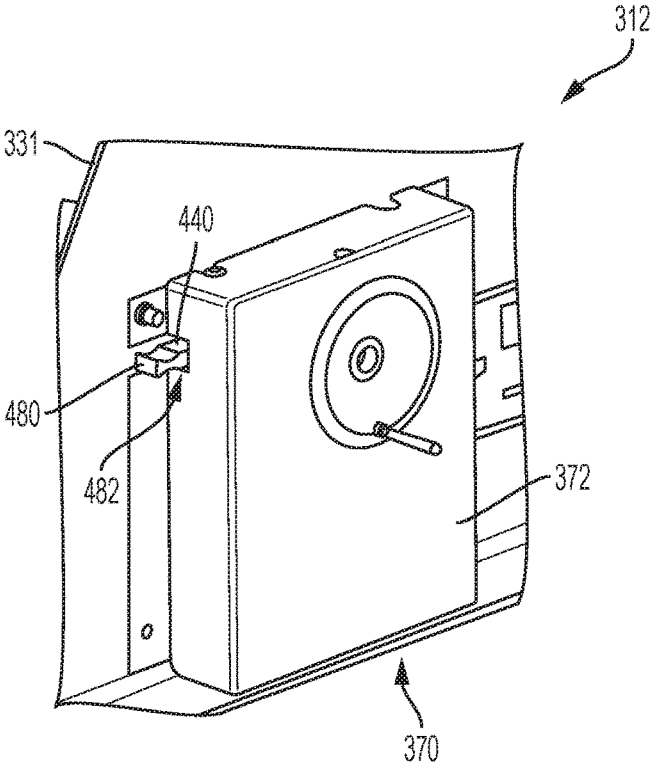
FIG. 16 is another partial side view of the exemplary dunnage conversion machine of FIG. 14.

Turning first to FIGS. 14-16, the dunnage conversion machine 312, also referred to as a converter 312, is provided for manual expansion of an expandable sheet stock material 326 of an expandable supply 324. The converter 312 generally includes a housing, which includes a frame 332. The illustrated frame 332 includes opposing, laterally-spaced side panels 331 coupled between laterally-extending support portions 333. The side panels 331 are supply supports and provide means for supporting sheet material. As illustrated, a lateral direction 340 extends transverse a longitudinal direction 350 extending from a rear of the frame 332 to a front of the frame 332 having an outlet for dispensing of expanded dunnage. The longitudinal direction 350 is parallel the feed direction of the sheet stock material through the converter 312.

A pair of axles 354 and 356 are supported by the side panel/supply supports 331, such as in notches 352 as shown. The rearmost axle 354 is positioned for supporting the supply 324 of expandable sheet stock material 326, such as receiving a core 360 of a roll of sheet material of the expandable supply 324. The forwardmost axle 356 is positioned for supporting a supply 362 of separator material 364.

A means for gripping the expandable sheet stock material 326 as it is drawn from the supply 324 includes an expansion assembly 370. The expansion assembly 370 is spaced downstream of the rearmost axle 354. The downstream direction is parallel the longitudinal direction 350 and follows the path of the expandable sheet stock material 326 from the supply 324 to an outlet 371 of the dunnage conversion machine 312. Laterally-opposed end portions of the expansion assembly 370 may be at least partially contained within an assembly housing 372 coupled to the frame 332.

The illustrated expansion assembly 370 includes a pair of expansion members 390 and 392 downstream of the rearmost axle 354. The pair of expansion members 390 and 392 are spaced adjacent one another, such as in engagement with one another, to enable gripping of the unexpanded sheet stock material 326 therebetween. Particularly, the depicted pair of expansion members 390 and 392 are positioned to grip the expanded form of the sheet stock material 326, i.e., a continuous strip of expanded dunnage. Tension to expand the expandable sheet stock material 326 from an unexpanded form to the expanded form of a continuous strip of dunnage at the outlet 371 is provided between the pair of expansion members 390 and 392 and an externally applied force provided adjacent the outlet 371, such as a manually applied force.

Turning to specifics of the expansion members 390 and 392, the first expansion member 390 and the second expansion member 392 are rotatably coupled to the side panels 331 of the frame 332 for rotation about parallel respective first and second axes of rotation 394 and 396. As depicted, opposed lateral ends 398 of each of the expansion members 390 and 392 are received in the side panels 331, though other means of support may be appropriate. The second expansion member 392 is a lower expansion member located below the first expansion member 390.

The expansion members 390 and 392 may include features that assist in maintaining the ability to apply tension to and feed the sheet stock material, expanded or unexpanded. For example, the depicted expansion members 390 and 392 each include a plurality of gripping members 420. The gripping members 420, such as teeth, of each of the respective expansion members 390 and 392 are laterally-spaced apart from one another. The depicted gripping members 420 expend fully circumferentially about the expansion members 390 and 392 and are equally laterally spaced apart from one another. The depicted gripping members 420 of the first expansion member 390 are laterally aligned at the same respective lateral positions between the opposed lateral ends 398 as the gripping members 420 of the second expansion member 392. Alternative spacings, arrangements, shapes, and/or sizes of gripping members may be suitable in other embodiments.

Figure 17:
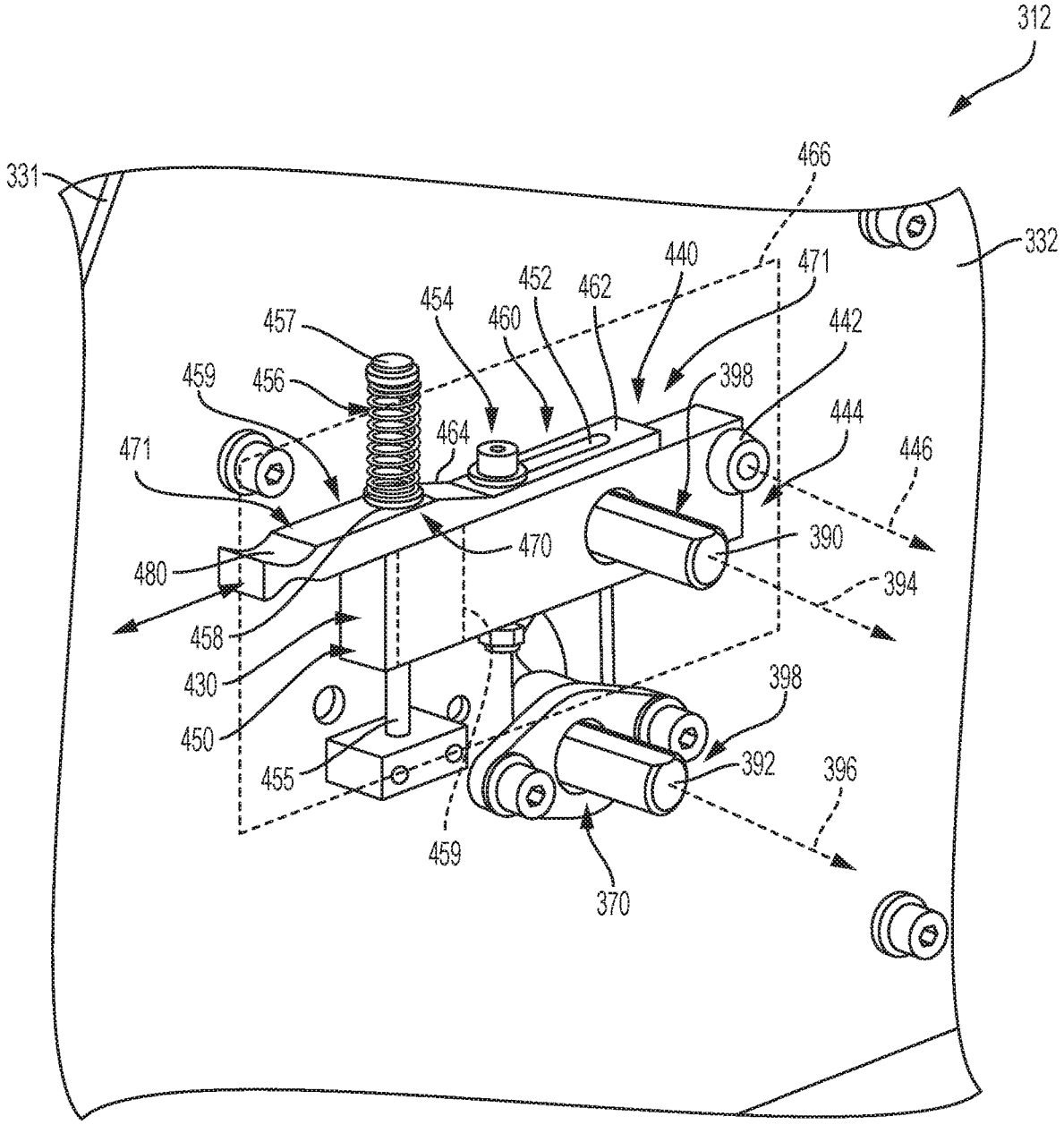
FIG. 17 is yet another partial side view of the exemplary dunnage conversion machine of FIG. 14, with part of the external housing removed.

Turning now to FIG. 17, spacing between the rotational axes 394 and 396 of the expansion members 390 and 392 is controlled to optimize a uniform gripping tension applied across a lateral length of the sheet stock material 326 drawn between the expansion members 390 and 392. The spacing may be adjusted to accommodate sheet material having differing different thicknesses and/or different slit arrangements. Adjustment of the spacing is jointly controlled by pivotably-mounted support members 430 of the expansion assembly 370 and by an adjustment means. For example, the expansion assembly 370 includes one or more adjustment members 440.

A set of opposed, laterally-spaced support members 430 are pivotably coupled to the respective side panels 331 of the frame 332. The pivotable support members 430 support the lateral end portions 398 of the first expansion member 390 such that pivoting movement of the pivotable support members 430 changes a position of the first axis of rotation 394 of the first expansion member 390 relative to the second axis of rotation 396 of the second expansion member 392. For example, the lateral end portions 398 of the first expansion member 390 are received through support openings in the pivotable support members 430. A fastener 442 couples one longitudinal end 444 of each support member 430 to the respective side panel 331. The pivotable support members 430 are configured to pivot about the fasteners 442 and about a pivoting axis 446 extending through the fasteners 442.

The adjustment means is selectively positionable to cause movement of the support members 430 about the pivoting axis 446, and thereby to change the position of the first axis of rotation 394 relative to the second axis of rotation 396. Moreover, the adjustment means is adjustable such that the parallel relationship between the first and second axes of rotation 394 and 396 is maintained at each of a plurality of positions of the adjustment means.

In alternative embodiments, the pivotable support members 430 may be integral with one another, such as being connected via a support extending laterally between the support members 430. Additionally or alternatively, a single adjustment member 440 may provide for pivoting adjustment of the pivotable support member(s), where the single adjustment member 440 may extend laterally between the pivotable support member(s). To simplify the description, only one of the adjustment members 440 will be described, with the understanding that an equivalent adjustment member 440 is provided on an opposite end of the expansion members 390 and 392.

As illustrated, a longitudinal end 450 of at least one of the pivotable support members 430 is moved by an adjustable adjustment means. As illustrated, the longitudinal end 450 of each of the pivotable support members 430 is disposed opposite the respective supported end 444 of the respective pivotable support member 430. The longitudinal ends 450 of each of the pivotable support members 430 are moved by a respective adjustment member 440. The respective adjustment members 440 typically are disposed against the respective pivotable support members 430.

The adjustment member 440 is coupled, such as linearly translatably coupled, to the frame 332, such as to the respective side panel 331. Particularly, the adjustment member 440 includes an adjustment orifice 452. A fastener 454, such as a threaded bolt, is received through the adjustment orifice 452 and holds the adjustment member 440 to the respective pivotable support member 430.

A support pin 455 (a bolt threaded into the block), also is received through the adjustment orifice 452 and is coupled to the respective side panel 331. A biasing member 456, such as a coil spring is disposed between a head 457 of the support pin 455 and the adjustment member 440. A flat washer 458 also may be disposed between the biasing member 456 and the adjustment member 440 to provide uniform application of force of the biasing member 456 to the adjustment member 440.

The pivotable support member 430 further may include a support orifice 459 extending therethrough for receiving the support pin 455. The support orifice 459 may have an oblong or elliptical shape for allowing pivoting of the pivotable support member 430 relative to the support pin 455. The coupling of the support member 430 on the support pin 455 enables guidance of the pivotable support member 430 during pivoting. In other embodiments, however, it may be suitable for the pivotable support member 430 not to capture the support pin 455.

The adjustment member 440 is selectively adjustable relative to the frame 332 and relative to the first axis of rotation 394 between any of a plurality of positions effecting pivoting of the pivotable support member 430. Movement of the adjustment member 440 is transferred into pivoting movement of the pivotable support member 430 by continued engagement of the adjustment member 440 with the pivotable support member 430, in coordination with a biasing force of the biasing member 456 applied to the adjustment member 440.

To allow for the adjustment, the adjustment member 440 includes a pair of opposing sections of differing thickness 459 and 460, one being thicker than the other. The sections 459 and 460 are defined by a spacing between an adjustment surface 462 of the adjustment member 440 and the pivotable support member 430. The thickness dimension of each of the sections of differing thickness 459 and 460 extends along a plane 466 that is disposed orthogonal to the first axis of rotation 394. As illustrated, the section 459 has a greater thickness dimension than the section 460. In other embodiments, the adjustment member 440 may include any suitable number of sections of differing thickness.

The sections of differing thickness 459 and 460 are linearly spaced apart, and longitudinally separated from one another, along the adjustment surface 462 of the adjustment member 440. A ramp portion 464 provides a change in height between the pair of sections 459 and 460. In other embodiments, the sections of differing thickness may be linearly spaced from one another along the adjustment surface 462 with any suitable spacing therebetween.

The adjustment member 440 is linearly translatable relative to the frame 332 to change the positioning of the sections of differing thickness 459 and 460 relative to the frame 332. Linear translation of the adjustment member 440 along the support member 430 causes the sections 459 and 460 each to be positionable between an acting position 470 and an adjacent non-acting position 471. Only one section of differing thickness 459 or 460 at a time can occupy the acting position 470.

The translation is effected by a user pulling or pushing on a handle portion 480 of the adjustment member 440 that extends through an opening 482 in the assembly housing 372. The ramp portion 464 allows for efficient linear translation of the adjustment member 440 as the flat washer 458 is engaged with the adjustment surface 462. After translation, the adjustment member 440 is maintained in position by the biasing force of the biasing member 456.

The plurality of adjustment positions of the adjustment member 440 are each predetermined and tactilely-detectable in view of the adjustment member 440 having a plurality of sections of differing thickness 459 and 460. The adjustment member 440 is engaged with the respective pivotable support member 430 such that selective positioning in any of the plurality of positions of the adjustment member 440 causes the sections 459 and 460 to be positionable relative to the first axis of rotation 394. As illustrated, at least a portion of the pivotable support member 430 is disposed between the acting position 470 and the first axis of rotation 394 to cause lifting or lowering pivoting movement of the support member 430.

The movement of the adjustment member 440 adjusts the respective pivotable support member 430 in any of a respective plurality of positions. The movement of the sections of differing thickness 459 and 460 thereby changes the position of the first axis of rotation 394 relative to the second axis of rotation 396 to vary the spacing therebetween.

In summary, a dunnage conversion machine 12, 112, 312 according to any of the FIGS. 1 and 4-17, for converting an expandable pre-slit sheet stock material into a relatively less dense dunnage product, includes an improved expansion assembly 20, 170, 370 that provides means for adjusting the spacing between axes of rotation 194, 196, 394, 396 of components 190, 192, 390, 392 through which the sheet stock material 26, 126, 326 is drawn. The adjustability enables pre-slit sheet stock materials of differing thicknesses and/or having differing slit patterns to be fed through the expansion assembly 20, 170, 370 with no or minimal compression of an expanded dunnage product, jamming in the conversion machine, bunching, and/or tearing of the pre-slit sheet stock material or expanded dunnage product 24, 130 resulting from expansion of the pre-slit sheet stock material 26, 126, 326.

Additionally, any of the aforementioned converters 12, 112, or 312 may include an optional separating means, such as a separator. With respect to the converter 12, but applicable to either of the converter 112 or 312, an optional separating means 22 (FIG. 1) may include a separate or sever distinct dunnage products 24 from the continuous strip of dunnage 26. An optional separator of the separating means 22 may include one or more cutting members, which may be actuated manually or automatically. An exemplary severing assembly is described in U.S. Pat. No. 4,699,609 to Ranpak Corp. of Concord Township, Ohio. In some situations, the separating means 22 may be omitted altogether, such as when discrete lengths of sheet material are supplied to the converter 12. Another alternative is to employ a sheet stock material that is perforated across its width so that a length of dunnage product can be torn from the dunnage strip 26. The perforations can be formed in the stock material before being supplied to the converter 12 or formed as part of the conversion process. Additionally or alternatively, the converter 12 may be configured to automatically separate a desired length of dunnage product from dunnage strip made of perforated stock material. This can be accomplished by providing an additional set of rotating members upstream or downstream of the downstream-most set of rotating members of the expansion assembly 20, and stopping whichever set is upstream, while continuing to feed sheet material through the other set of rotating members.

The present invention also provides a method of converting an expandable sheet stock material 26, 126, 326 into a relatively less dense dunnage product 24, 130. The method includes the step of (a) drawing a first sheet stock material having a first slit pattern from a supply 124, 324 between a pair of rotating members 190, 192, 390, 392 under tension to cause the first sheet stock material to expand in at least one dimension. The method also includes the steps of (b) replacing the first sheet stock material with a second sheet stock material having a second slit pattern, (c) adjusting a spacing between axes of rotation 194, 196, 394, 396 of the rotating members 190, 192, 390, 392, and (d) drawing the second sheet stock material between the pair of rotating members 190, 192, 390, 392 under tension to cause the second sheet stock material to expand in at least one dimension. The adjusting step may include providing tactilely-detectable positions representing at least two different amounts of spacing between the axes of rotation 194, 196, 394, 396 of the rotating members 190, 192, 390, 392. The adjusting step may include eccentric rotation to effect adjusting between the positions.

Although the invention has been shown and described with respect to a certain illustrated embodiment or embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment or embodiments of the invention. The term "coupling" may refer to direct coupling of one integer to another or to indirect coupling of integers, such as with one or more integers therebetween. The term "and/or," such as used in "a and/or b" is defined as including either or both of (i) a and b and (ii) a or b.

The invention claimed is:

1. A dunnage conversion machine, comprising:

a frame having laterally-spaced support members;

a support coupled to the frame capable of supporting a supply of sheet stock material;

first and second expansion members rotatably coupled to the frame for rotation about respective parallel first and second axes of rotation, the first and second expansion members being spaced apart to receive an expandable sheet stock material therebetween; and laterally-spaced support members pivotably coupled to the frame to support lateral end portions of the first expansion member such that pivoting movement of the support members changes a position of the first axis of rotation of the first expansion member relative to the second axis of rotation of the second expansion member; and an adjustment member coupled to one pivoting support member of the pivoting support members, the adjustment member having a plurality of sections, with at least two of the sections having a different thickness, where the adjustment member is selectively positionable in any of a plurality of positions such that the sections of differing thickness are positionable relative to the first axis of rotation to adjust the position of the one pivoting support member in any of a plurality of positions, and where adjusting the position of the adjustment member changes the position of the first axis of rotation relative to the second axis of rotation;

where the adjustment member is linearly translatable between the plurality of positions of the adjustment member.

2. The dunnage conversion machine of claim 1, where at least a portion of the support member is disposed between the positionable sections of differing thickness and the first axis of rotation.

3. The dunnage conversion machine of claim 1, where the dunnage conversion machine further includes another adjustment member coupled to the other pivoting support member of the pivoting support member.

4. The dunnage conversion machine of claim 1, where the thickness dimension of each of the sections of differing thickness extend along a plane disposed orthogonal to the first axis of rotation.

5. The dunnage conversion machine of claim 1, where the adjustment member is configured such that the plurality of positions into which the adjustment member is selectively positionable are predetermined positions.

6. The dunnage conversion machine of claim 1, where the adjustment member is selectively positionable such that the parallel relationship between the first and second axes of rotation is maintained at each of the plurality of positions of the adjustment member.

7. The dunnage conversion machine of claim 1, where the positionable sections of differing thickness are interchangeably positionable into an acting position effecting movement of the position of the first axis of rotation, and where one section of differing thickness at a time can occupy the acting position.

8. The dunnage conversion machine of claim 1, where adjacent sections of the plurality of sections of differing thickness are longitudinally separated from one another along a length of the adjustment member by a respective ramp portion.

9. The dunnage conversion machine of claim 1, in combination with a supply of expandable pre-slit stock material.

10. The dunnage conversion machine of claim 1, further including a biasing member disposed between at least one of the pivoting support members and the adjustment member, where the biasing member applies force to the adjustment member to maintain the adjustment member in each of the plurality of positions.

* * * * *